US010947735B2

(12) United States Patent
Auer

(10) Patent No.: US 10,947,735 B2
(45) Date of Patent: Mar. 16, 2021

(54) PERGOLA SHADE SYSTEM FOR A PIER

(71) Applicant: Thomas Edwin Auer, Delafield, WI (US)

(72) Inventor: Thomas Edwin Auer, Delafield, WI (US)

(73) Assignee: Thomas Edwin Auer, Delafield, WI (US)

( * ) Notice: Subject to any disclaimer, the term of this patent is extended or adjusted under 35 U.S.C. 154(b) by 0 days.

(21) Appl. No.: 16/249,484

(22) Filed: Jan. 16, 2019

(65) Prior Publication Data

US 2020/0181918 A1 Jun. 11, 2020

Related U.S. Application Data

(60) Provisional application No. 62/617,886, filed on Jan. 16, 2018.

(51) Int. Cl.
*E04F 10/00* (2006.01)
*E02B 3/06* (2006.01)
*E04B 1/343* (2006.01)

(52) U.S. Cl.
CPC ..... *E04F 10/005* (2013.01); *E02B 3/068* (2013.01); *E04B 1/34321* (2013.01)

(58) Field of Classification Search
CPC ..... E04F 10/005; E04F 10/00; E02B 3/068; E04H 15/58; E04H 15/38; E04H 15/06; E04H 6/04
USPC ..... 114/361
See application file for complete search history.

(56) References Cited

U.S. PATENT DOCUMENTS 1,643,464 A * 9/1927 McCullers ..... B63C 15/00 114/263
2,708,346 A * 5/1955 Smith ..... B63C 1/00 405/3
2,912,703 A * 11/1959 Murphy ..... E04H 4/084 4/494
2,930,387 A * 3/1960 Streich ..... B63B 59/00 135/137
4,487,212 A * 12/1984 Moore ..... B60J 11/00 135/117
5,261,435 A * 11/1993 Stanley ..... E04H 6/04 135/90
5,775,353 A * 7/1998 Johnson ..... B63B 17/02 135/96
6,102,059 A * 8/2000 Miller ..... E04H 6/04 135/141
6,846,129 B1 * 1/2005 Edson ..... B63C 3/06 405/3
6,976,806 B2 * 12/2005 Edson ..... B63C 3/06 405/3
7,240,683 B2 * 7/2007 Zutich ..... A45B 23/00 135/121
7,481,174 B2 * 1/2009 Atkinson ..... E02B 3/28 114/220

(Continued)

*Primary Examiner* — Beth A Stephan
(74) *Attorney, Agent, or Firm* — Boyle Fredrickson, S.C.

(57) ABSTRACT

A pergola shade system designed for use with a pier over water. The pergola shade system includes as its primary components a roof assembly, a framework to support the roof assembly above the pier, and an anchor assembly that removably and securely mounts the roof assembly and framework to the pier. The anchor assembly is constructed of components that permit the roof structure and framework of the pergola shade system to be both easily erected on a pier for use and easily disassembled from the pier for storage.

20 Claims, 17 Drawing Sheets

(56) References Cited

U.S. PATENT DOCUMENTS 7,913,710 B2 * 3/2011 Bougioukos ..... E04H 6/025 135/87
8,286,651 B1 * 10/2012 Maffett ..... E04H 6/025 114/361
9,404,281 B1 * 8/2016 Donnay ..... E04H 15/36
9,598,147 B2 * 3/2017 Templeton ..... B63B 17/02
9,644,338 B1 * 5/2017 Bisson ..... E02D 27/52
2005/0016438 A1 * 1/2005 Hey ..... B63C 5/00 114/361
2005/0252542 A1 * 11/2005 Basta ..... B63C 5/00 135/156
2007/0068634 A1 * 3/2007 Unrast ..... E04F 10/00 160/59
2007/0295379 A1 * 12/2007 Basta ..... B63C 5/00 135/122
2008/0168938 A1 * 7/2008 Impey ..... E02B 3/068 114/264
2013/0206051 A1 * 8/2013 Kent ..... B63B 17/02 114/361
2014/0026804 A1 * 1/2014 Templeton ..... B63B 17/02 114/361
2014/0093346 A1 * 4/2014 Kent ..... B63B 17/02 414/744.2
2015/0003918 A1 * 1/2015 Peterson ..... E02B 3/068 405/218
2015/0308143 A1 * 10/2015 Levin ..... B63B 17/02 135/121
2016/0289989 A1 * 10/2016 Creagh ..... E04H 6/04
2018/0111663 A1 * 4/2018 Levin ..... B63B 17/02
2019/0011079 A1 * 1/2019 Levin ..... H02S 20/30
2019/0062101 A1 * 2/2019 Bielfelt ..... B63B 17/02
2020/0036325 A1 * 1/2020 Poivet ..... H02S 30/20

* cited by examiner

PERGOLA SHADE SYSTEM FOR A PIER

BACKGROUND OF THE INVENTION

The present invention relates to an outdoor structure for providing shade or shelter from the elements, such as a pergola, and more specifically to a pergola shade system for use with a pier.

Pergolas are well known, and are mainly used as an architectural landscaping structure to define an open outdoor sitting space that offers protection from the sun allowing a user to cool off, relax, and enjoy nature's beauty. Pergolas typically have four vertically extending columns or posts that define the outdoor space. These columns or posts may be free-standing or affixed to a surface such as the ground, a deck or a patio, and are topped with an open roof comprised of cross-beams, spaced rafters and slats to provide shade. The slats may also be movable to adjust for the angle of the sun, and to control the amount of shade desired. In some cases, the roof may be covered with a retractable canopy for better protection from the sun and rain. Pergolas typically also have accessories such as a bench, a swing, a hammock, lights, curtains, and heaters resulting in the creation of usable "outdoor rooms."

A pergola may be designed in many different shapes and sizes, and may have a variety of architectural features. Although pergolas typically have four corner columns or posts for supporting a roof structure, some pergola designs are similar to awnings in that they have an overhanging roof structure extending outwardly from a building such that the inner end of the roof structure is mounted to an exterior wall of the building, and the outer end of the roof structure is supported by one or more columns or posts. This type of pergola design is commonplace for backyard house patios, as well as for drive-up window ordering stations of fast food restaurants. See for example U.S. Pat. No. 6,591,556.

Yet another type of pergola or outdoor shelter is one that has a cantilever design, i.e. where the roof structure is supported only on one end with its other end being unsupported and extending outwardly from its supported end. See for example D687,969, D659,852, D420,812, U.S. Pat. Nos. 7,913,710, and 7,240,683. Pergolas, however, especially cantilevered pergolas, have not been adapted for use with a structure such as a pier which extends over water.

SUMMARY OF THE INVENTION

A pergola shade system designed for outdoor use with a pier extending over water. The pergola shade system includes as its primary components a roof assembly forming a canopy for casting shade over a pier, a framework to support the roof assembly above the pier, and an anchor assembly that removably and securely mounts the roof assembly and framework to the pier. The anchor assembly is constructed of components that permit the roof structure and framework of the pergola shade system to be both easily erected on a pier for use and easily disassembled from the pier for storage.

In one embodiment, the pier includes a floor supported by a plurality of spaced inner floor joists and an outer stringer joist, and the anchor assembly removably mounts the roof assembly and framework to the outer stringer joist. Preferably, the anchor assembly removably and pivotally mounts the roof assembly and framework to the outer stringer joist to permit the roof assembly and framework to move in a vertical plane between a substantially upright vertical position and a substantially prone horizontal position. In this preferred embodiment, the framework has at least one upright support column having an upper end supporting the roof assembly and a lower end, and the anchor assembly includes a backer plate attached to the outer stringer joist, and a hinge member pivotally attaching the upright support column to the backer plate to permit the roof assembly and framework to move between said substantially upright vertical position and said substantially prone horizontal position.

In another embodiment, the pier includes a floor supported in a raised position above water by at least one post, wherein the post has a lower end extending below the floor into water and an upper end extending above the floor, and the anchor assembly mounts the roof assembly and framework to the upper end of the post above the floor of the pier. In this embodiment, the framework has at least one upright support column having an upper end supporting the roof assembly and a lower end, and the anchor assembly includes a sleeve having a top end and a bottom end. The top end of this sleeve receives and secures the lower end of the upright support column therein, and the bottom end of this sleeve receives and secures the upper end of the post therein.

In both embodiments, the roof assembly is slidably received on the upright support column for movement between a plurality of raised and lowered positions above a pier. In order to accomplish such movement, the pergola shade system utilizes a hoist assembly for moving the roof assembly between any desired raised or lowered positions.

Both embodiments also include an adjustable plumbing system for positioning the upright support column in a substantially vertical orientation, an adjustable leveling system for positioning the roof assembly in a substantially horizontal orientation, and a stabilizing assembly for the lower end of the upright support column. In the embodiment where the framework and roof assembly is pivotally mounted to the outer stringer joist of a pier, the stabilizing assembly preferably comprises a tie-back arrangement to provide supplemental rigidity to the backer plate, as well as stability and support for the framework and roof assembly when erected. The tie-back arrangement preferably comprises a turnbuckle extending between the lower end of the upright support column and one of the inner floor joists of the pier. The length of the turnbuckle is adjustable in order to accommodate different pier structure designs, and to ensure the upright support column may be moved to a vertical orientation.

Further, the roof assembly includes a plurality of roof sections each movable between multiple shade-providing positions to adjust the location of the shade being cast on the pier by the roof assembly. The roof assembly is preferably mounted in a cantilevered manner on the upright support column.

DETAILED DESCRIPTION OF THE INVENTION

Figure 1:
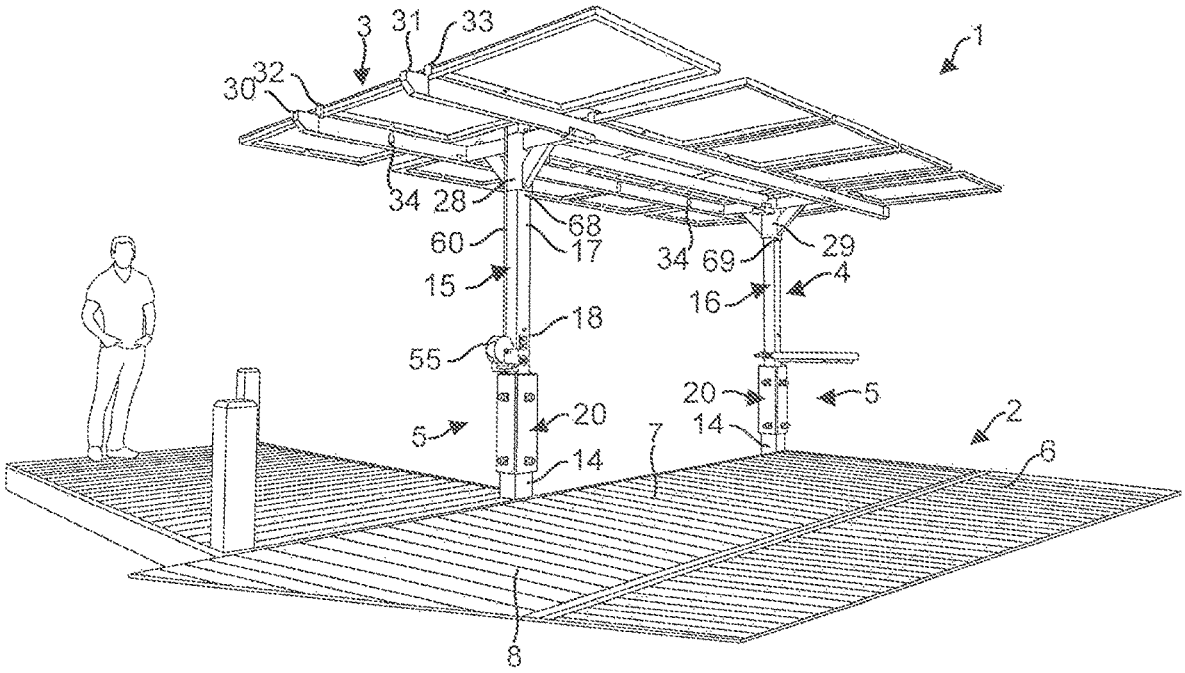
FIG. 1 is a perspective view looking from the side and upwardly at one embodiment of a pergola shade system for use with a pier over water in accordance with the present invention.

Referring now to the drawings, FIG. 1 illustrates a shade system in the form of a pergola, generally designated by the number 1, designed for use with a pier over water, generally designated by the number 2. As used herein, the term "pier" or "pier structure," refers to a pier, a dock, a wharf, a jetty, a quay, a landing stage, a seawall, or any similar raised structure which typically provides a walkway over and above a body of water, such as a lake, a river, a stream, a reservoir, a flowage, an ocean, or similar body of water. The "pier" or "pier structure" may be permanent, temporary, or of the floating type. Such pier structures are usually constructed of wood, concrete, brick, steel, aluminum, or a polymeric material such as fiberglass.

A first embodiment of the pergola shade system 1 is illustrated in FIGS. 1-4 and a second embodiment is illustrated in FIGS. 14-17. The pergola shade system 1 includes as its primary components a roof assembly 3, a framework 4 to support the roof assembly 3 above the pier 2, and an anchor assembly 5 removably mounting the roof assembly 3 and framework 4 to the pier 2. As illustrated, the roof assembly 3 is preferably mounted on the framework 4 in a cantilevered manner. The term "cantilever" or "cantilevered" refers to a design where one or more of the outer ends of roof assembly 3 are free and unsupported.

In the first embodiment illustrated in FIGS. 1-4, the pier 2 is shown as extending over and above the surface of a body of water, such as an inland lake. The pier 2 illustrated includes a walkout section 6 leading out from shore, and an outer L-shaped landing section 7. The landing section 7 includes a generally horizontal platform or floor 8 supported in its middle by spaced parallel inner floor joists 9 and at its outer ends by outer stringer joists 10. The pier floor 8, as well as the outer stringer joists 10 and floor joists 9 are all supported above the surface of the water by one or more vertically extending legs or posts 11 each having a foot 12 at its lower end engaging the lake bed to support the pier 2, as is conventional for a pier structure. In this first embodiment of FIGS. 1-4, legs or posts 11 have a lower end 13 having foot 12 thereon extending below the floor 8 into the water and an upper end 14 extending above the floor 8, and said anchor assembly 5 mounts the roof assembly 3 and framework 4 to the upper end 14 of the leg or post 11. As illustrated, posts 11 are composed of wood, and are rectangular in shape typically sized to be about 6 inches by 6 inches in cross section. Posts 11, however, may be composed of other materials, and may have different dimensions depending on the design of the pier structure.

The framework 4 of the pergola shade system 1 has two spaced and vertically extending upright support columns 15 and 16 each of which has an upper end 17 and a lower end 18, and a winch beam 19 spanning between the upper ends 17 of columns 15 and 16. The winch beam 19 is hollow and functions to house the pulley system of the hoist assembly hereinafter to be described. The upright support columns 15 and 16 as well as the winch beam 19 are preferably composed of extruded aluminum, and are rectangular in shape typically sized to be about 4 inches by 4 inches in cross section.

In order to mount framework 4 and roof assembly 3 on the upper ends 14 of legs or posts 11, there is provided an anchor assembly comprised of two rectangular-shaped sleeve members 20 shown best in FIGS. 3 and 5-8. Each sleeve member 20 is identical and preferably composed of aluminum, and has a top end 21 for receiving the lower end 18 of upright column 15 or 16 and a bottom end 22 for receiving the upper end 14 of either leg or post 11. The top end 21 of sleeve 20 includes a pair of spaced inserts 23 and 24 which enable the sleeve 20 to accommodate the smaller dimension of the lower ends 18 of columns 15 and 16. The lower end 18 of each support column 15 or 16 is welded to the inserts 23 and 24 at the top end 21 of sleeve 20 to provide an integral unit for ease of installation. The upper end of leg or post 11 is received within the bottom end 22 of sleeve member 20 and is secured therein by a plurality of carriage bolts 25 extending through the sides of sleeve member 20 and engageable with the upper end 14 of leg or post 11.

Carriage bolts 25 not only securely mount columns 15 and 16 on posts 1, they also provide a plumbing system with enables the upright support columns 15 and 16 to be adjusted to a substantially vertical orientation. By independently turning one or more carriage bolts 25, the upright support posts 15 and 16 can be plumbed into a vertical orientation.

Carriage bolts 25 also provide a stabilizing system for the pergola shade system 1. Instead of simply functioning as set screws engaging the outer wood surfaces of posts 11, each carriage bolt 25 bears against a washer 26 and wood screw 27 inserted into the upper end 14 of posts 11 to thereby enable adequate force be applied by each bolt 25 against the washers 26 in the upper end 14 of leg or post 11 to stabilize the mounting of the upright support columns 15 and 16 in sleeve members 20. Without the washers 26 and wood screws 27, the carriage bolts 25 would merely be turned into the relatively soft wood of posts 11. Although this might temporarily secure columns 15 and 16 on posts 11, it would not adequately stabilize the mounting arrangement on posts 11 over time. Thus, in order to install the wood screws 27 and washers 26 in their proper locations, the sleeve 20 would be placed over the upper end 14 of each post 11, and the location of carriage bolts 25 marked on the surface of the post 11. The sleeve 20 is then removed and the wood screws 27 and washers 26 inserted into post 11 at the marked locations so that they align with the carriage bolts 25 when the sleeve 20 is re-positioned over the upper ends 14 of posts 11.

The roof assembly 3 is best illustrated in FIGS. 1, 2, 4 and 9-10, and includes a pair of spaced slider assemblies 28 and 29, a pair of spaced beams 30 and 31 supported by and spanning between the slider assemblies 28 and 29, and one or more sun screen sections 45, 46, 47, 48 and 49 which are removably mounted on and supported by the beams 30 and 31. The slider assemblies 28 and 29 are slidably received on the upper ends 17 of upright support columns 15 and 16, respectively, for movement between a plurality of raised and lowered positions above the floor 8 of pier 2. The slider assemblies 28 and 29 are identical so only assembly 28 is illustrated in detail and will hereinafter be described. More specifically, slider assembly 28 comprises a substantially T-shaped structure having a rectangular-shaped hollow head 35 having an internal rectangular opening dimensioned to be slightly larger than the rectangular upper end 17 of support column 15 so as to permit sliding movement of assembly 28 thereon. A pair of cross arms 36 and 37 project laterally from opposite sides of head 35 for supporting beams 30 and 31. A U-shaped saddle 38 is mounted at the outer end of arm 36 for receiving beam 30 therein, and a similar U-shaped saddle 39 is mounted at the outer end of arm 37 for receiving beam 31 therein. Each saddle 38 and 39 includes a bottom foam pad 40 and a pair of side foam pads 41 which combine to frictionally engage beams 30 and 31 when beams 30 and 31 are inserted into saddles 38 and 39 and thereby secure beams 30 and 31 on the arms 36 and 37. A support arm 42 extends between head 35 and cross arm 36, and a support arm 43 extends between head 35 and cross arm 37 to provide auxiliary support for arms 36 and 37 which carry the weight of sun screen sections 45-49. A mounting flange 44 projects inwardly from head 35 in the same direction as the beams 30 and 31. Mounting flange 44 is used with the pulley system of the hoist assembly hereinafter to be described.

The support beams 30 and 31 are elongate members, preferably composed of aluminum, and are removably secured within the saddles 38 and 39 to support the sun screen sections 45-49. As shown best in FIG. 2, the support beams 30 and 31 extend parallel to one another and longitudinally in the same direction as winch beam 19, and on either side of winch beam 19, and thereby span the distance between slider assemblies 28 and 29. The beam 30 has a plurality of spaced brackets 32 projecting from its upper surface, and the beam 31 likewise has a corresponding number of spaced brackets 33 projecting from its upper surface. Brackets 32 and 33 are aligned with one another to slidably receive screen sections 45-49, as shown best in FIG. 4. As also seen best in FIG. 4, beams 30 and 31 further include a plurality of spaced latches 34 mounted thereon at locations corresponding to the locations of sun screen sections 45-49 for releasably securing sun screen sections 45-49 to support beams 30 and 31.

Figure 2:
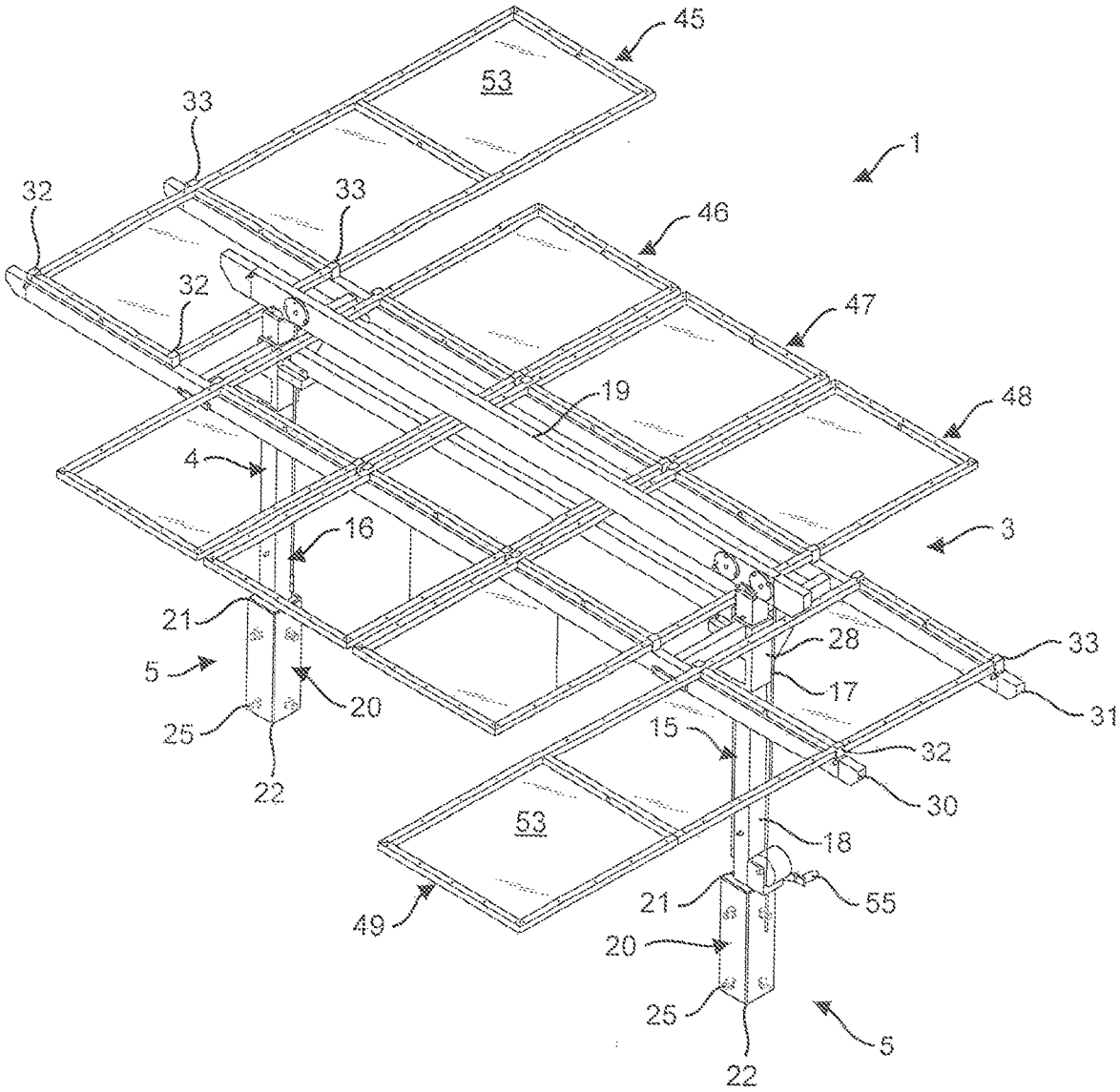
FIG. 2 is a perspective view looking from the side and downwardly at the pergola shade system of FIG. 1.
Figure 3:
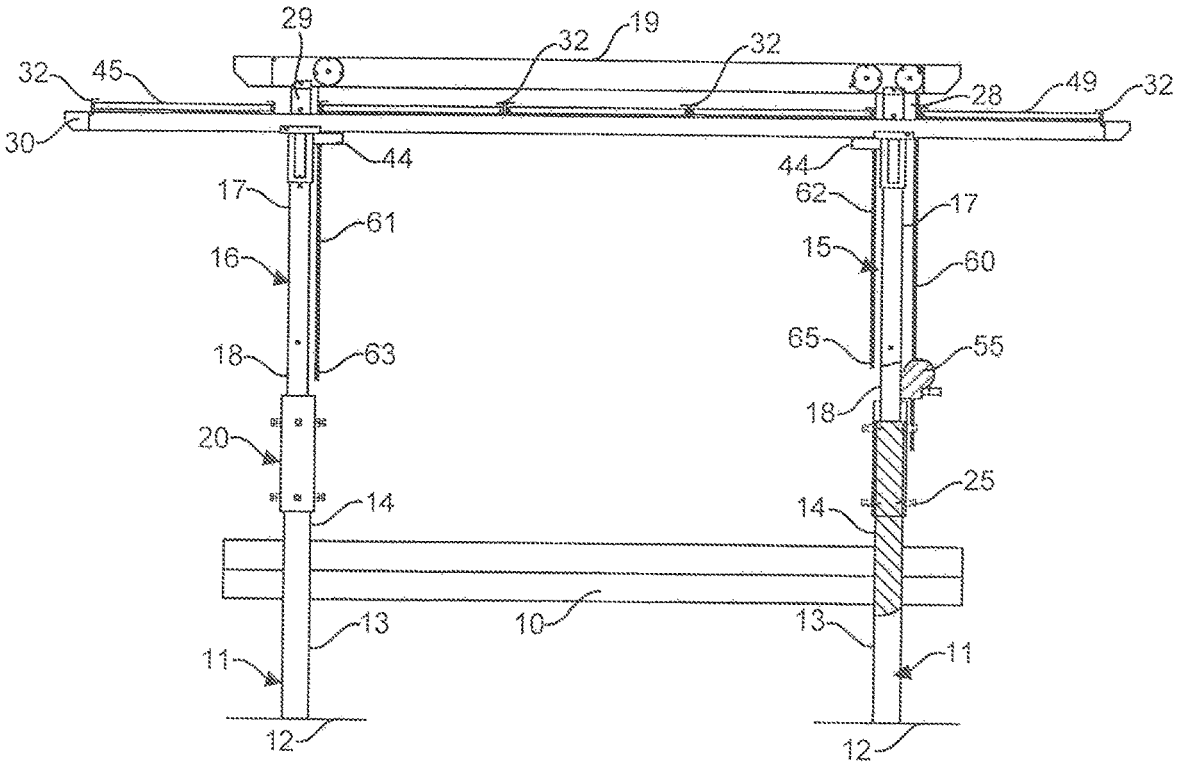
FIG. 3 is a side elevation of the pergola shade system of FIG. 1.
Figure 4:
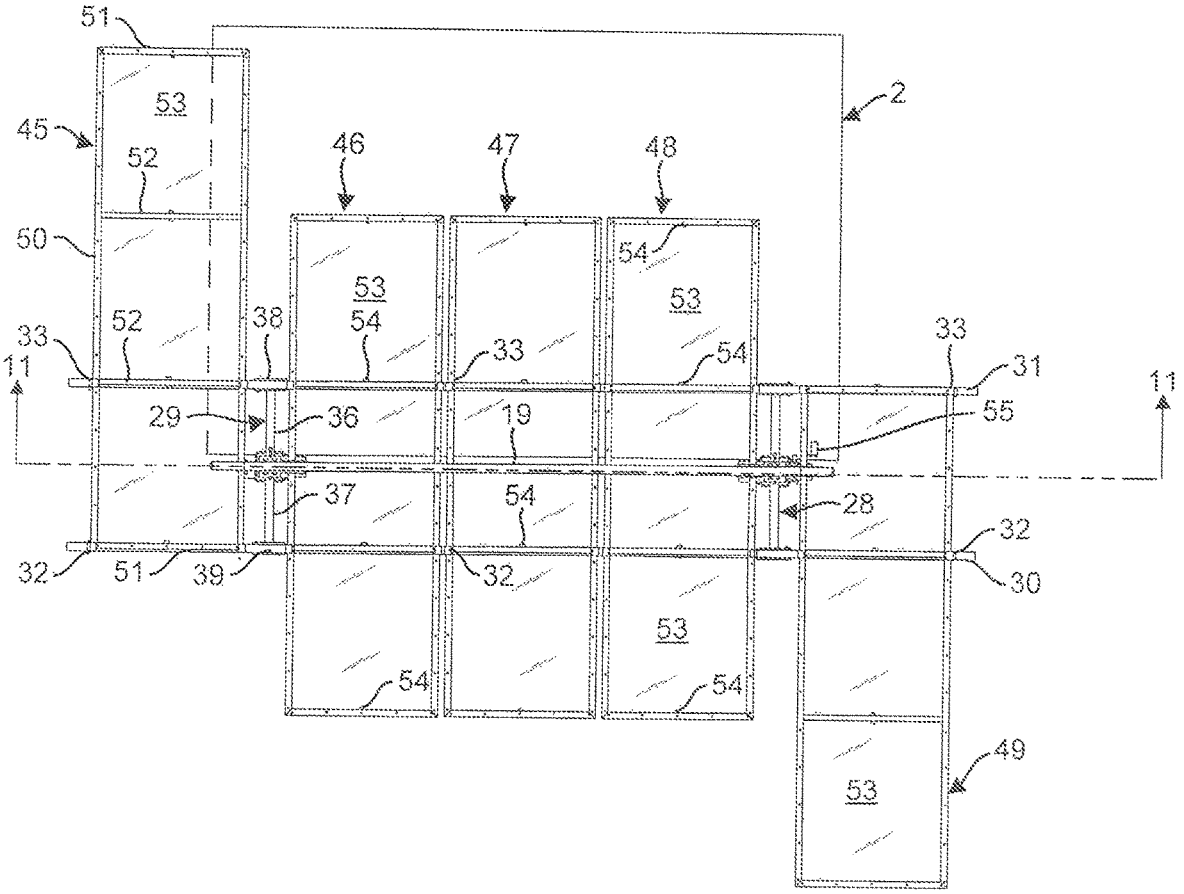
FIG. 4 is a top view of the pergola shade system of FIG. 1.
Figure 5:
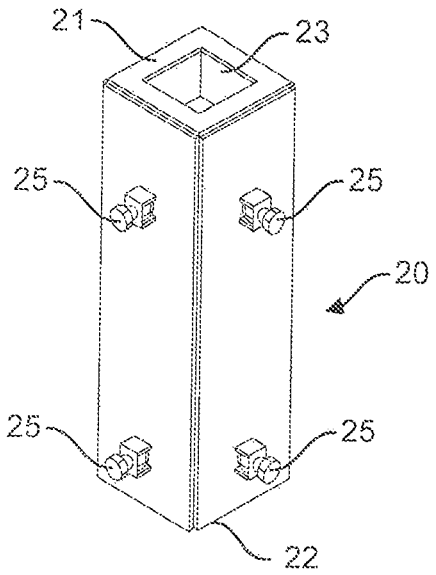
FIG. 5 is a perspective view of a mounting sleeve for the pergola shade system of FIG. 1.
Figure 6:
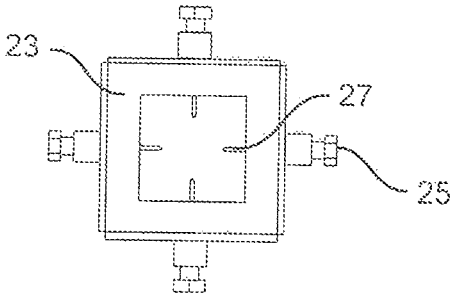
FIG. 6 is a top view of the mounting sleeve illustrated in FIG. 5.
Figure 7:
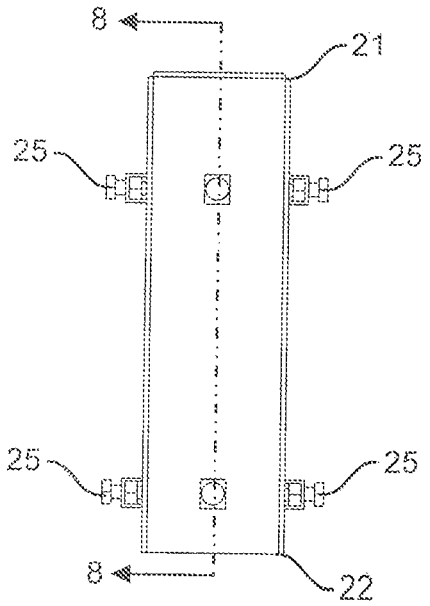
FIG. 7 is a side elevation view of the mounting sleeve illustrated in FIG. 5.
Figure 8:
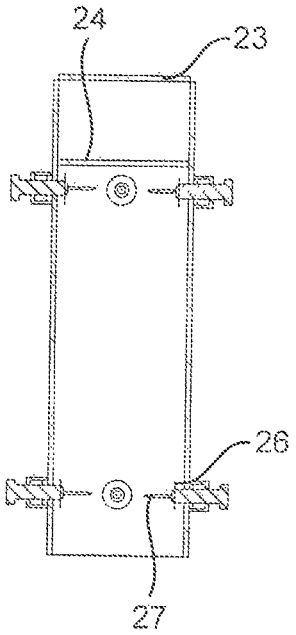
FIG. 8 is a sectional view of the mounting sleeve taken along the line 8-8 in FIG. 7.
Figure 9:
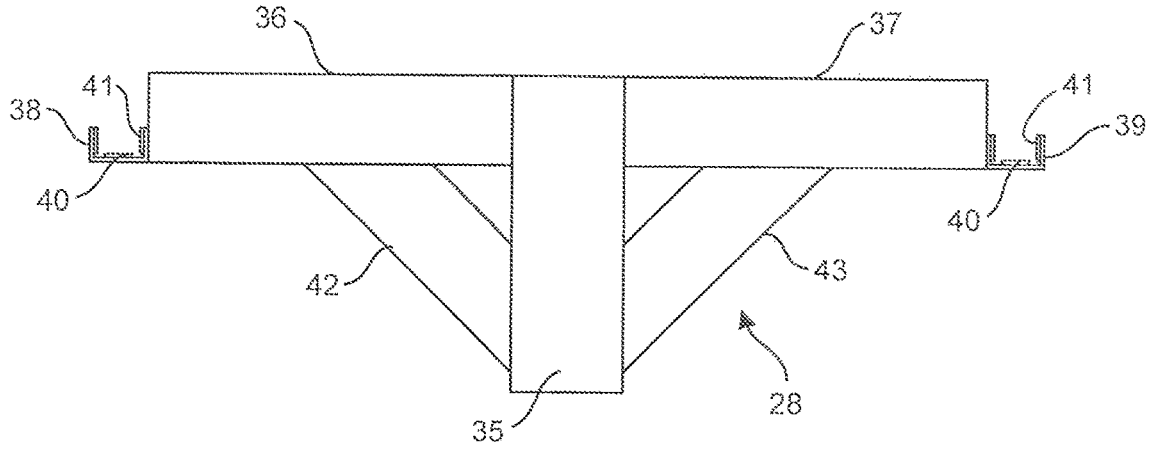
FIG. 9 is an end view of a slider assembly used in the roof assembly of the pergola shade system of FIG. 1.
Figure 10:
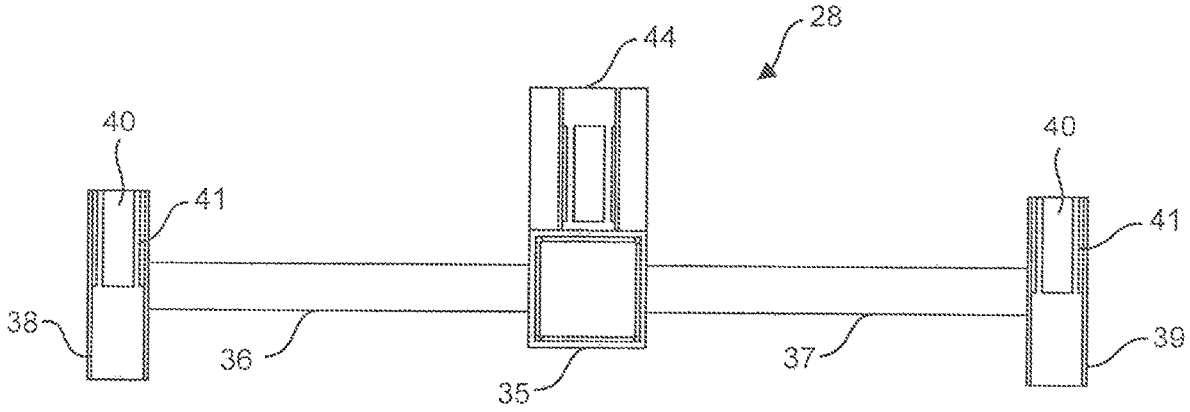
FIG. 10 is a top view of the slider assembly illustrated in FIG. 9.

Sun screen sections 45-49 are all identical in structure and therefore only one need be described. More specifically, sun screen section 45 includes a rectangular-shaped outer frame having a pair of long frame members 50 which are typically about 10 feet long and a pair of short frame members 51 which are typically about 3 feet wide. Inner stiffener members 52 interconnect and extend between the long frame members 50 to form three panels for each section 45-49, and function to provide rigidity to the outer frame. Each panel includes a material 53 such as a fabric or a screen that functions to provide shade on pier 2. Further, a plurality of hooks 54 are mounted on the short frame members 51 and the inner stiffener members 52. Hooks 54 cooperate with the latches 34 on beams 30 and 31 to removably mount the sun screen sections 45-49 on beams 30 and 31. Thus, once screen sections are located in the desired position, latches 34 engage hooks 54 to secure the screen sections 45-49 in place. As shown in FIG. 2, the latches 34 and hooks 54 enable the sun screen sections 45-49 to be movable between multiple shade-providing positions to adjust the location of the shade being cast on pier 2 by the roof assembly 3. Further, it should be understood that although the drawings illustrate the roof assembly 3 as having five sun screen sections 45-49, there may be more or fewer sun screen sections depending upon the desired dimensions for the pergola shade system 1 and the pier design on which it will be used.

Figure 11:
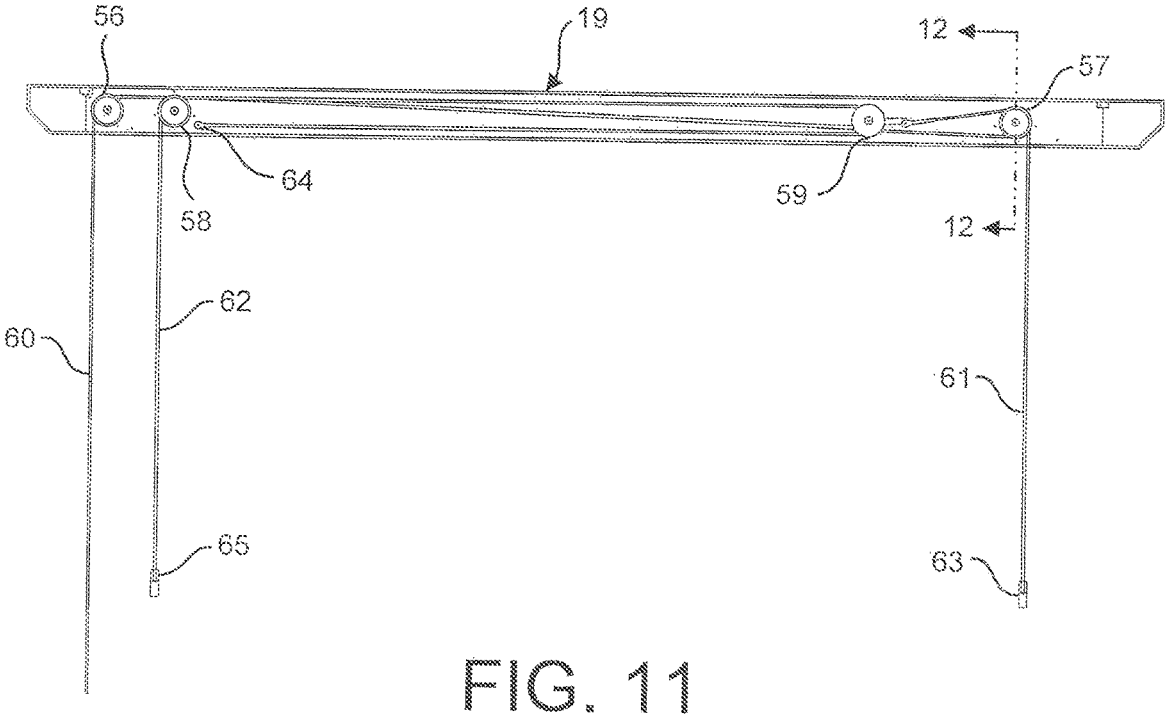
FIG. 11 is a side view of a hoist assembly used to raise and lower the roof assembly of the pergola shade system of FIG. 1.
Figure 12:
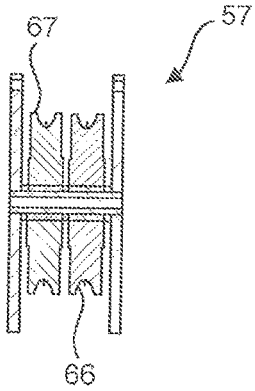
FIG. 12 is a sectional view of a double pulley used in the hoist assembly illustrated in FIG. 11 taken along line 12-12 in FIG. 11.

As previously described, the roof assembly 3 including the slider assemblies 28 and 29 as well as the support beams 30 and 31 and the sun screen sections 45-49 slide on the upper ends 17 of the support columns 15 and 16. A mechanical hoist system comprised of a winch 55, a set of four pulleys 56-59, and three cables 60-62 is employed to raise and lower the roof assembly 3 to the desired location at the upper ends 17 of each column 15 and 16. As shown best in FIGS. 1 and 11, winch 55 is mounted on column 15, while the pulleys 56-59 are mounted within winch beam 19. Pulley 56 is fixed in position and mounted at one end of winch beam 19 adjacent column 15 and above winch 55, and pulley 57 is fixed in position and mounted at the opposite end of winch beam 19 adjacent column 16. Pulley 58 is also in a fixed position and is located adjacent to end pulley 56. Pulley 58 is a moving pulley that traverses back and forth within winch beam 19. One end of cable 60 is wound around and attached to winch 55 and then extends upwardly adjacent column 15 where it is wound about pulley 56. From pulley 56, cable 60 extends substantially horizontally within winch beam 19 until it winds around pulley 57 and is attached to moving pulley 59. Cable 61 is also wound around end pulley 57 and has one end attached to the moving pulley 59, and then extends downwardly adjacent column 16 where it is attached to a swage bolt 63 which in turn is attached to the mounting flange 44 of slider assembly 29. Cable 62 has one end fixedly mounted to winch beam 19, as at 64, and extends substantially horizontally within winch beam 19 until it winds around moving pulley 59. Cable 62 then extends back around fixed pulley 58, and then downwardly adjacent column 15 where it is attached to a swage bolt 65 which in turn is attached to the mounting flange 44 of slider assembly 28. It should be noted that the pulleys 56, 58 and 59 are single pulleys while the pulley 57 is a double pulley, as shown in FIG. 12. Pulley 57 thus has a rotating wheel 66 for cable 60 and a separate rotating wheel 67 for cable 62.

In operation, a winch 55 is turned in one direction to raise the roof assembly 3, and in the opposite direction to lower the roof assembly 3. When winch 55 is turned to wind cable 60 thereon, pulley 56 turns counterclockwise and cable 60 pulls moving pulley 59 towards end pulley 57. As this action occurs, end pulley 57 rotates counterclockwise to move cable 61 upwardly. Simultaneously, pulley 58 rotates clockwise to move cable 62 upwardly. Thus, since the end of cable 61 is attached to slider assembly 29 and the end of cable 62 is attached to slider assembly 28, the roof assembly 3 is raised upwardly. A pin 68 extends through openings in column 15 and a pin 69 extends through openings in column 16 to hold slider assemblies 28 and 29 in their raised positions, and as will be readily understood, pins 68 and 69 must be removed from columns 15 and 16 before the roof assembly 3 may be lowered from a raised position.

Figure 13:
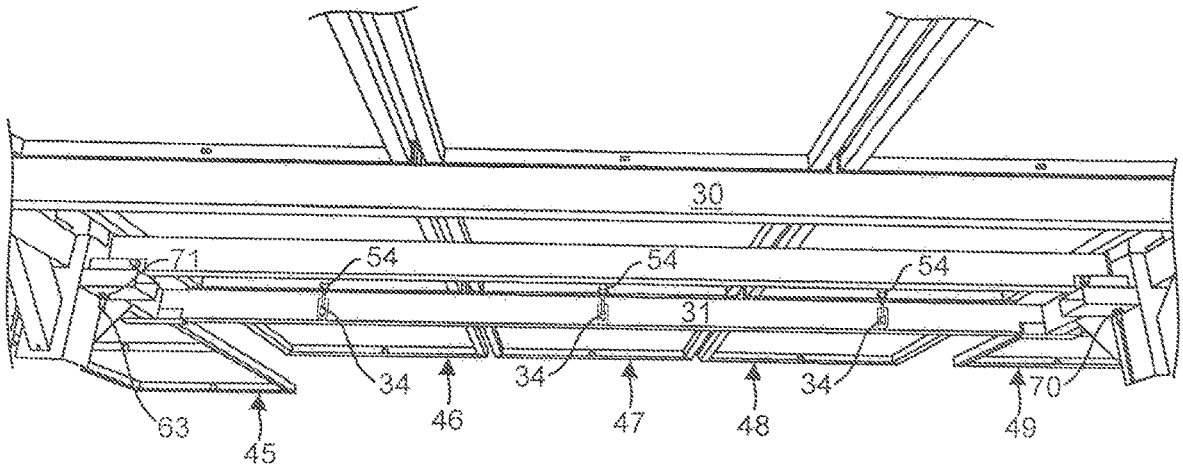
FIG. 13 is a perspective view looking from below and upwardly at the underside of the roof assembly.
Figure 14:
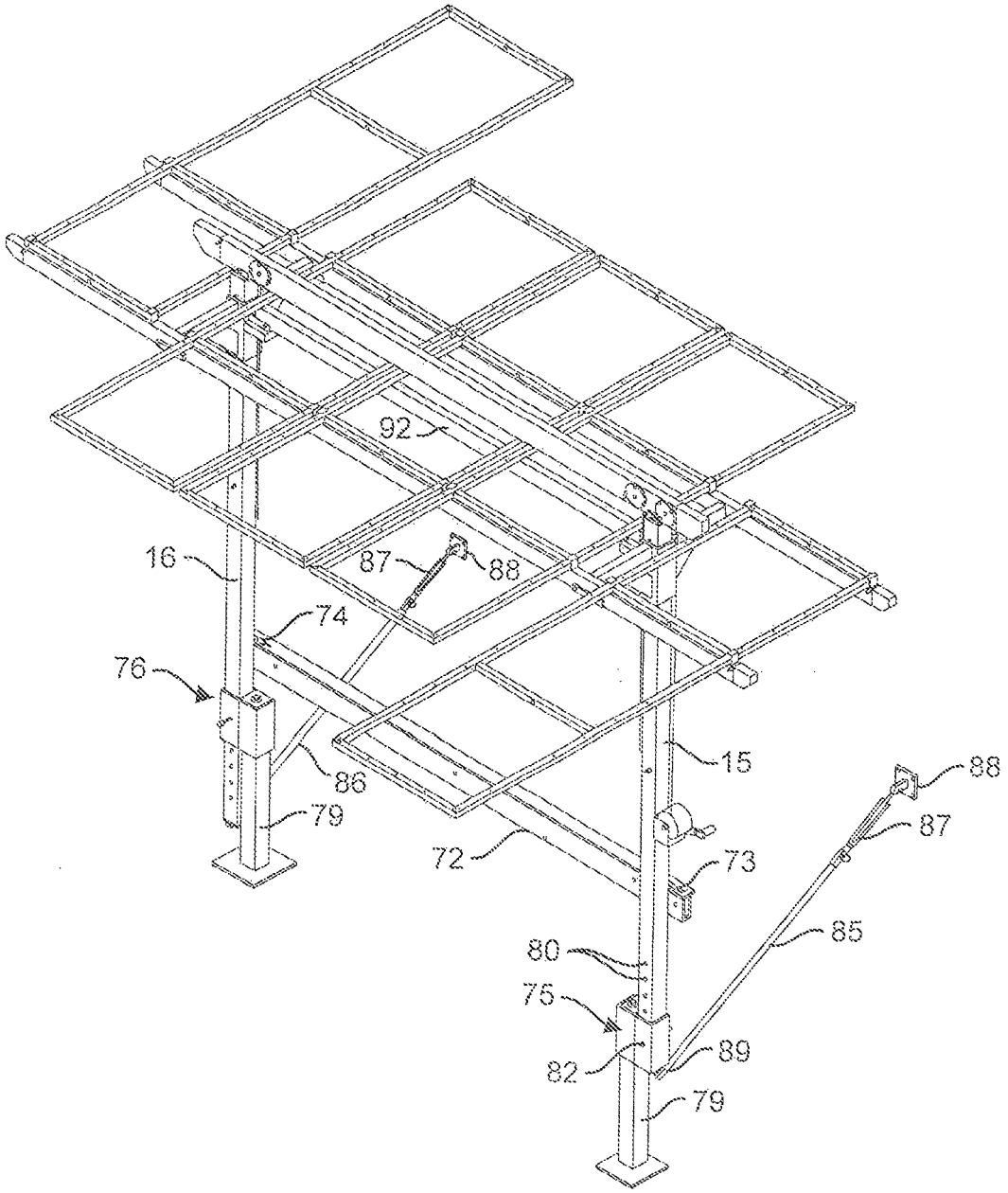
FIG. 14 is a perspective view looking from the side and downwardly at a second embodiment of a pergola shade system for use with a pier over water in accordance with the present invention.
Figure 15:
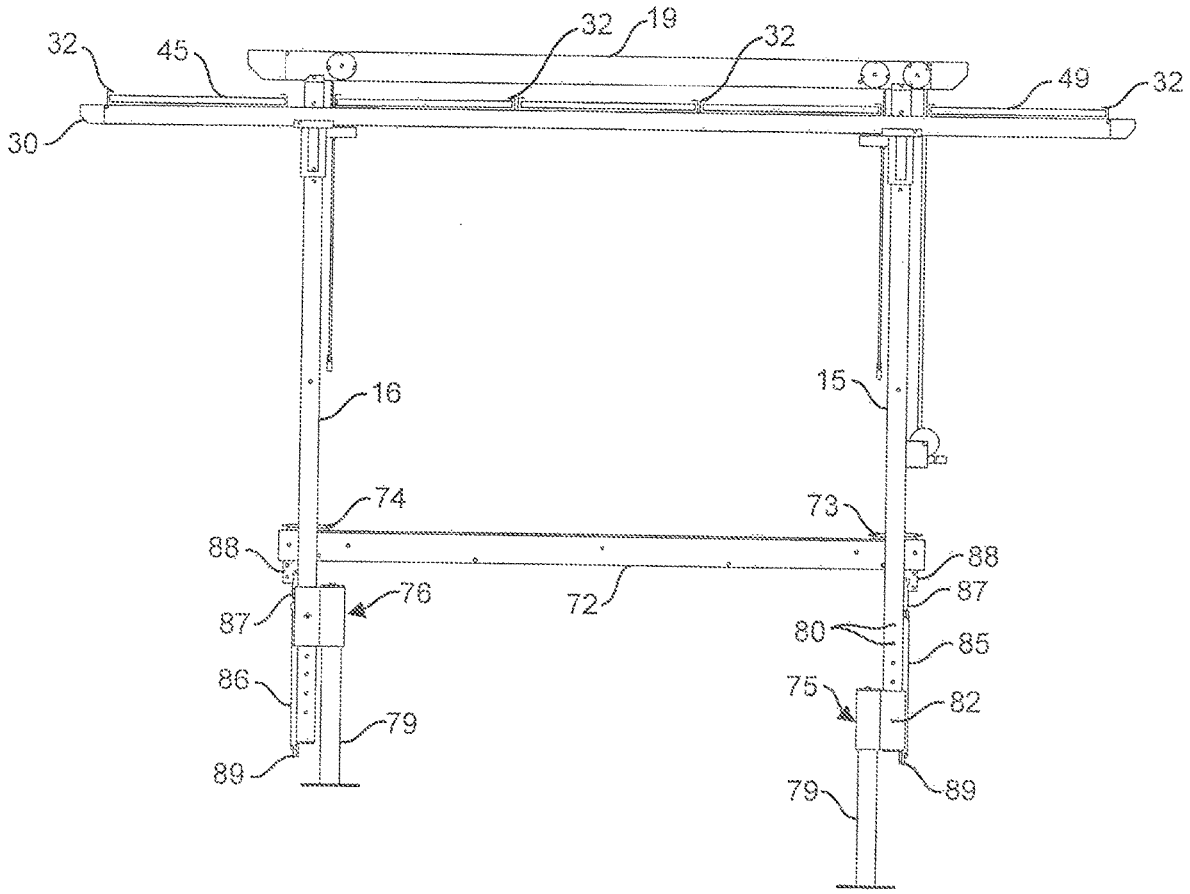
FIG. 15 is a side elevation of the pergola shade system of FIG. 14.
Figure 16:
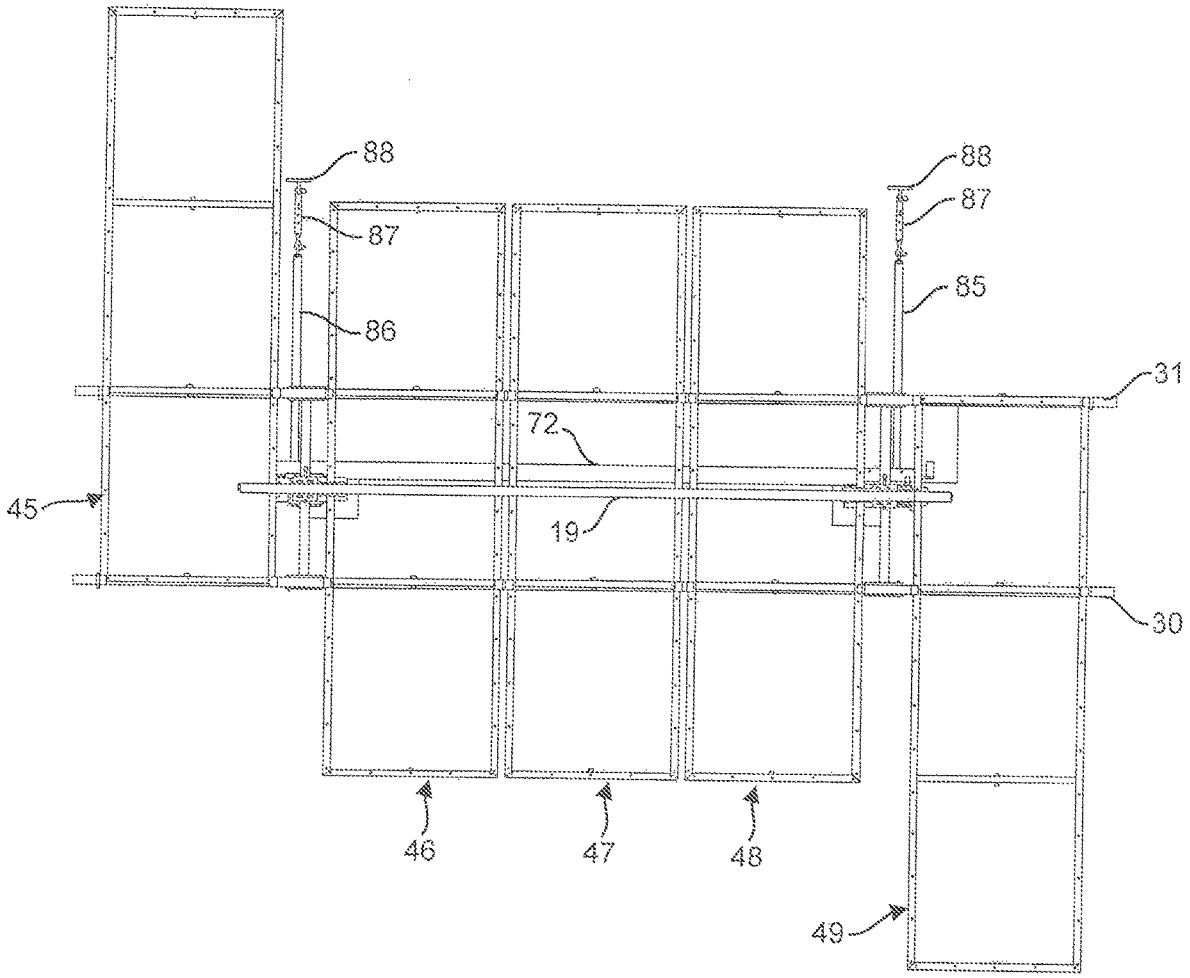
FIG. 16 is a top view of the pergola shade system of FIG. 14.
Figure 17:
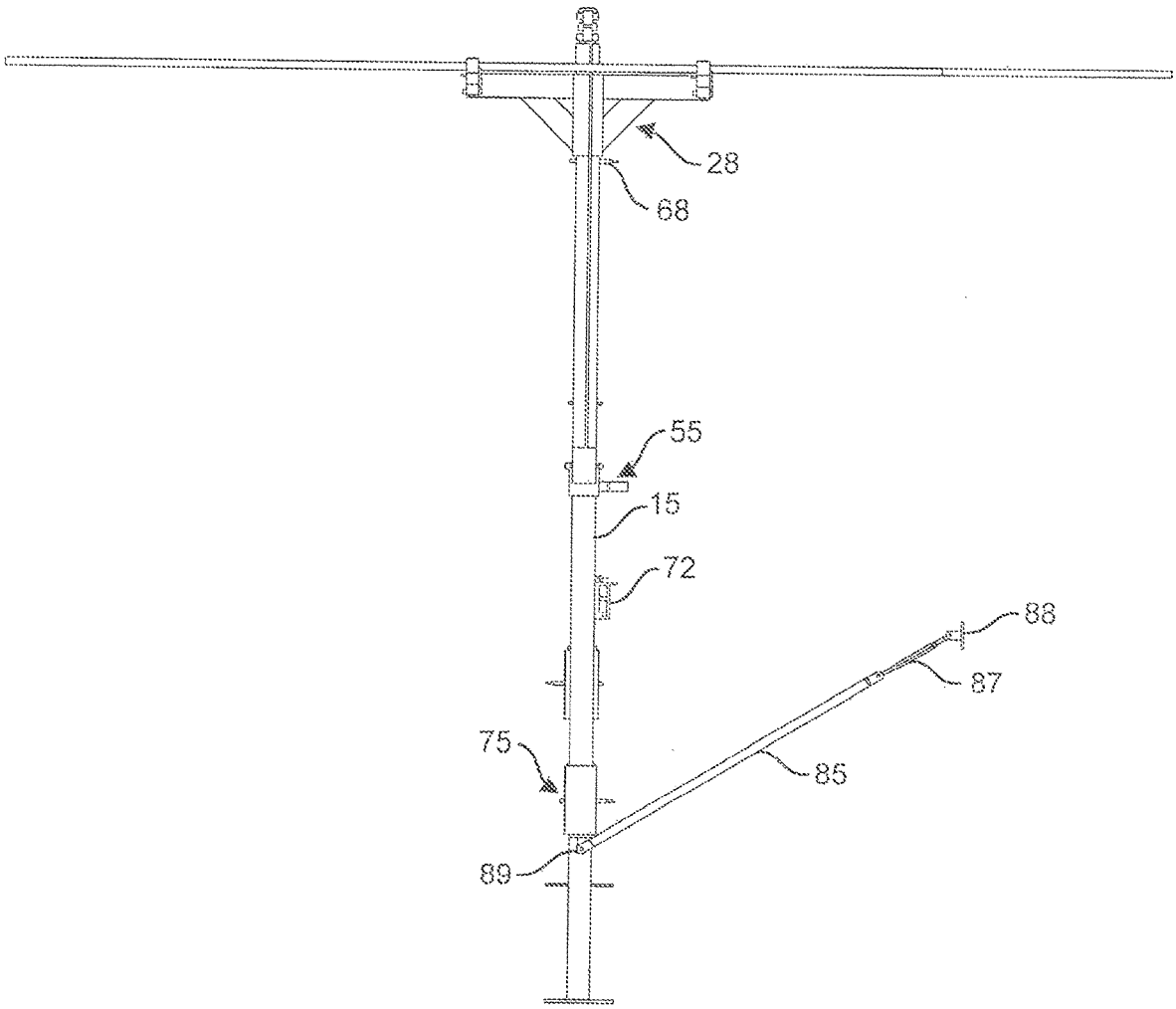
FIG. 17 is an end view of the pergola shade system of FIG. 14.

Referring now to FIG. 13, there is illustrated a leveling system for roof assembly 3. As previously described, one end of cable 62 is attached to swage bolt 65 and one end of cable 61 is attached to swage bolt 63. As shown in FIG. 13, swage bolt 65 extends vertically through flange 44 of slider assembly 28 and is secured thereto by a nut 70. Likewise, swage bolt 63 extends vertically through the flange 44 of slider assembly 29 and is secured thereto by a nut 71. As a result, the roof assembly 3 can be leveled by turning one or both of the nuts 70 and 71 which in turn will raise or lower the slider assemblies 28 and 29 to result in a substantially level roof assembly 3.

The roof assembly 3 also has a cross beam 92 extending between and supported at its opposite ends by the mounting flanges 44 of the slider assemblies 28 and 29. Cross beam 92 may be used to attach and support a hanging plant, a hammock, a swinging chair, a swinging bench, or similar accessories.

Referring now to FIGS. 14-17, there is illustrated a second embodiment of the pergola shade system 1 of the present invention. It should be noted that in this embodiment, the roof assembly, the framework and the hoist system illustrated is identical to the roof assembly 3, the framework 4 and the hoist system previously illustrated and described herein with respect to the first embodiment and thus need not be repeated. The difference between the second embodiment shown in FIGS. 14-17 versus the first embodiment shown in FIGS. 1-4 lies in the manner by which the pergola shade system 1 is anchored to the pier 2. More specifically, the anchor assembly for this second embodiment removably and pivotally mounts the roof assembly and framework to pier 2 which permits the roof assembly and framework to move in a vertical plane between a substantially upright vertical position and a substantially prone horizontal position The anchor assembly illustrated in FIGS. 14-17, and in more detail in FIGS. 20 and 21, has as its primary components a longitudinally extending backer plate 72 attached by bolts 80 to the outer stringer joist 10, a hinge member 73 pivotally attaching the upright support column 15 to the backer plate 72, and a second hinge member 74 pivotally attaching the upright support column 16 to the backer plate 72 to thereby permit the roof assembly 3 and framework 4 to move between a substantially upright vertical position and a substantially prone horizontal position.

As illustrated in FIGS. 14-17, the pergola shade system 1 further includes a stabilizing assembly for the lower ends 18 of the upright support columns 15 and 16. This stabilizing assembly comprises a pair of integral double sleeve members 75 and 76 associated with columns 15 and 16 respectively. As both sleeve members are identical, only one need be described. More specifically, sleeve member 75 has a first rectangular sleeve section 77 for receiving and securing the lower end 18 of the upright support column 15, a second rectangular sleeve section 78 for receiving and securing an auxiliary leg 79 therein in a position parallel to and adjacent to the support column 15, and an adjustable positioning mechanism for adjusting the vertical position of the auxiliary leg 79 with respect to the upright support column 15. Sleeve section 77 is dimensioned to slidably receive therethrough the lower end 18 of column 15, and the lower end 18 of column 15 further includes a plurality of vertically spaced holes 80 which may be aligned with a corresponding hole 81 in sleeve section 77 and secured in place by a pin 82 to adjust the vertical position of sleeve member 75 to ensure auxiliary leg 79 will be supported on the lake bottom.

Figure 19:
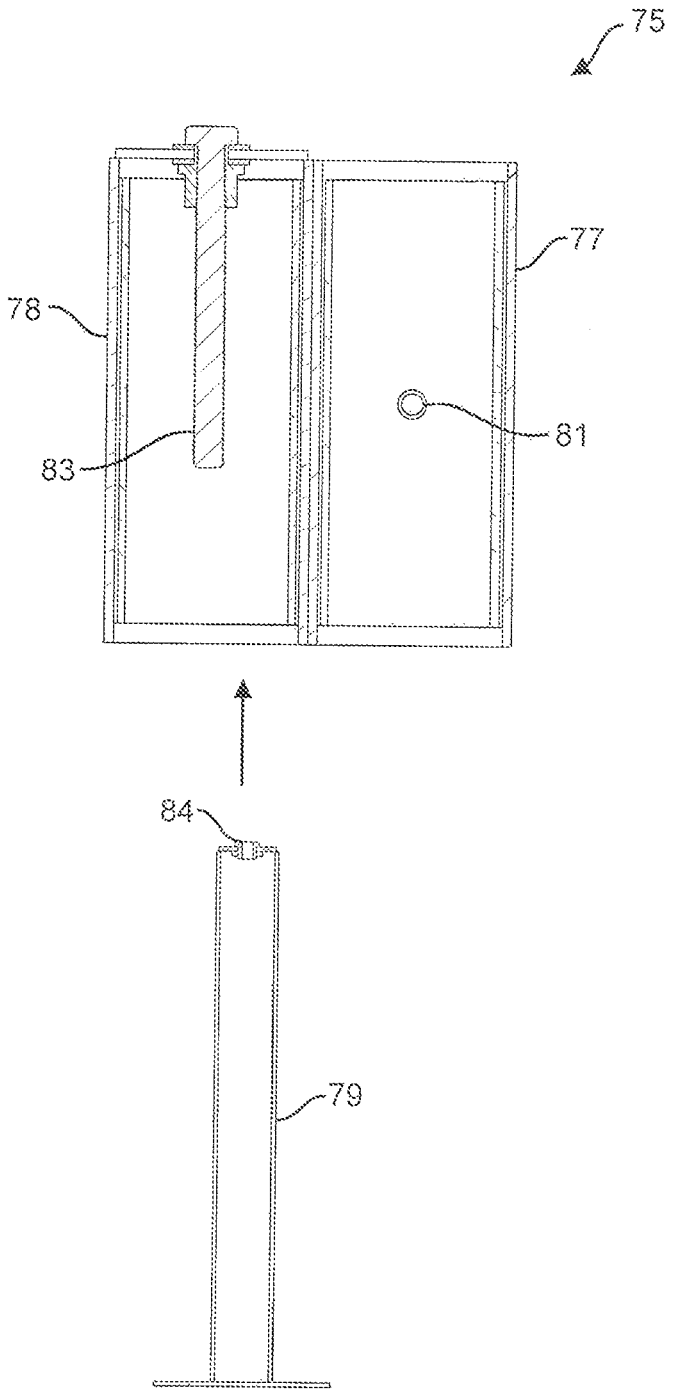
FIG. 19 is an enlarged and exploded side view in section illustrating the double sleeve and auxiliary leg used to stabilize the pergola shade system of FIG. 14.

As shown in FIG. 19, sleeve section 78 is dimensioned to receive therein the upper end of auxiliary leg 79. Sleeve section 78 includes a fixed threaded bolt 83 extending longitudinally therein, and the upper end of auxiliary leg 79 has an integral nut 84 mounted therein. Thus, auxiliary leg 79 may be secured within sleeve section 78 by engaging the nut 84 on bolt 83 and rotating the auxiliary leg 79. The length of leg 79 projecting from sleeve member 75 may be controlled by rotating leg 79 on bolt 73 to the desired depth within sleeve section 78 to ensure leg 79 will be supported on the lake bottom.

Figure 18:
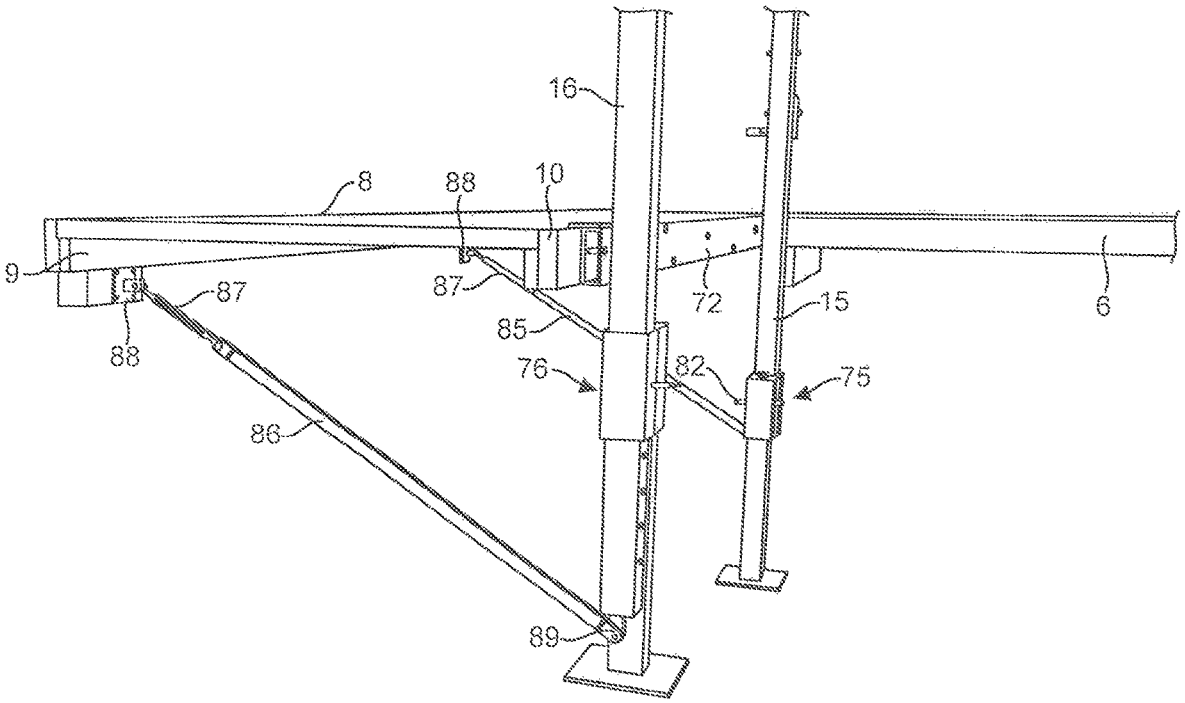
FIG. 18 is a perspective view looking from one end at the mounting and stabilizing arrangement for removably and pivotally mounting the pergola shade system of FIG. 14 to the side of a pier.
Figure 20:
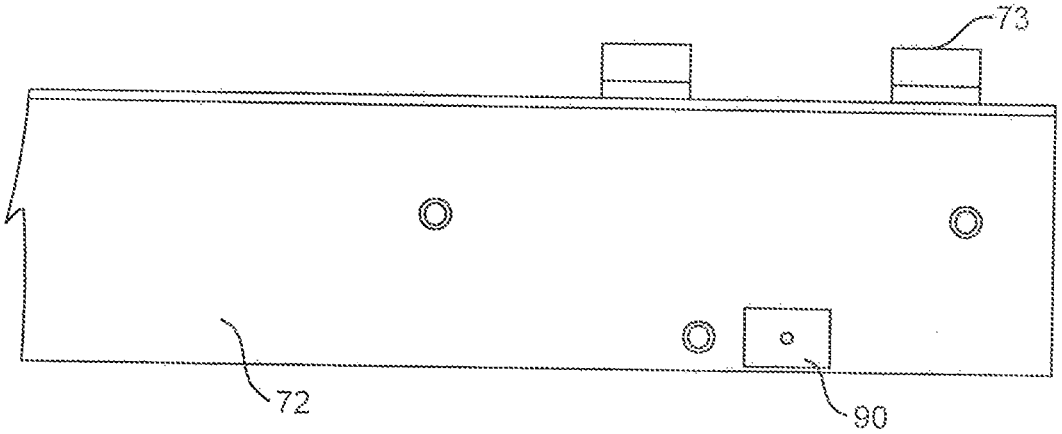
FIG. 20 is an enlarged side view of one end of the backer plate used to removably and pivotally mount the pergola shade system of FIG. 14.
Figure 21:
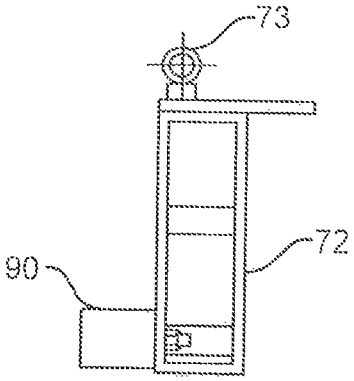
FIG. 21 is an end view of the backer plate illustrated in FIG. 20.
Figure 22:
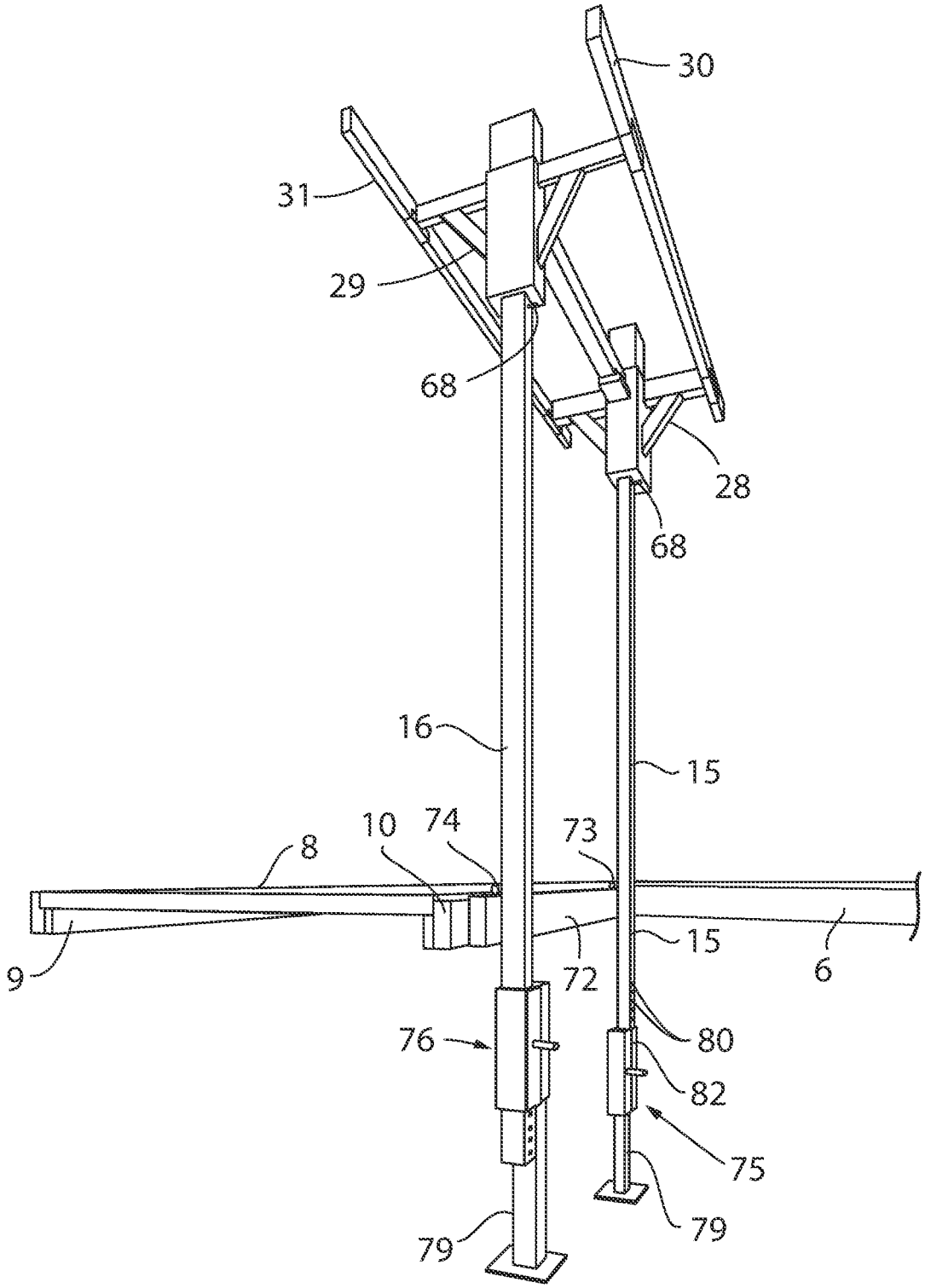
FIG. 22 is a perspective view of the pergola shade system in a substantially upright vertical position.
Figure 23:
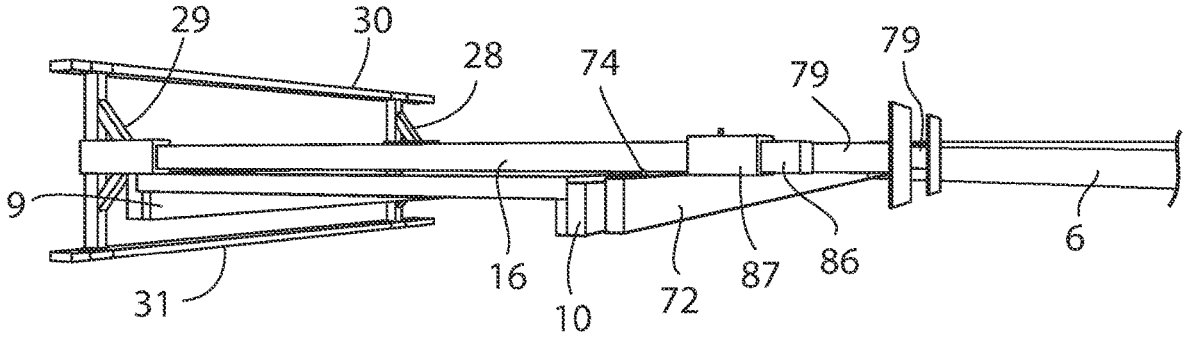
FIG. 23 is a perspective view of the pergola shade system in a substantially prone horizontal position.

As illustrated in FIG. 18, the pergola shade system 1 further includes an adjustable plumbing system for positioning the upright support columns 15 and 16 in a substantially vertical orientation. In this embodiment, the adjustable plumbing system includes a tie-back assembly comprising a pair of turnbuckles 85 and 86 extending between the lower ends 18 of the upright support columns 15 and 16 and one of the inner floor joists 9 of the pier 2. As both turnbuckles are identical, only turnbuckle 85 need be described. More specifically, as shown, an outer end 87 of turnbuckle 85 is attached via a mounting plate 88 to an inner floor joist 9 beneath floor 8, and its inner end 89 is attached, as by welding, to the lower end 18 of support column 15. Thus, when the length of turnbuckle is adjusted, the lower end 18 of column 15 is moved inwardly or outwardly as desired to establish a vertical orientation for column 15. A rubber spring member 90, which is best seen in FIGS. 20 and 21, is attached to backer plate 72 and column 15 at the location of the hinge member 73 that pushes against column 15 and compresses to facilitate plumbing of column 15. The tie-back assembly also provides supplemental rigidity to the backer plate 72 as well as stability and support for the framework 4 and roof assembly 3. The tie-back arrangement illustrated includes an adjustable tie-back assembly 57 associated with sleeve 50, and an identical adjustable tie-back assembly 58 associated with sleeve 51. The length of turnbuckles 85 and 86 are also adjustable to accommodate different pier structure designs.

I claim:

1. A pergola shade system comprising:

a framework having at least one upright support column, each upright support column having an upper end and a lower end;

a roof assembly forming a canopy antilevered over a pier, said roof assembly non-rotatably attached to each upright support column; and an anchor assembly coupling said at least one upright support column to at least one of an outer stringer joist of a pier and a respective post of said pier;

wherein the anchor assembly includes a backer plate attached to said outer string joist when coupling said at least one upright support column to said outer stringer joist of said pier.

2. The pergola shade system of claim 1, wherein said anchoring assembly coupling said at least one upright support column to the outer stringer joist further includes said pier having a floor supported by a plurality of spaced inner floor joists and said outer stringer joist, said at least one post supporting said floor, said plurality of spaced inner floor joists, and said outer stringer joist above water.

3. The pergola shade system of claim 1, wherein said anchor assembly includes at least one sleeve having a top end removably mounted to said lower end of each upright support column and a bottom end removably mounted to the respective at least one post.

4. The pergola shade system of claim 1, wherein said anchor assembly coupling said at least one upright support column to the outer stringer joist further includes a hinge member pivotally attaching each upright support column to said backer plate to permit said roof assembly and framework to move between a substantially upright vertical position and a substantially prone horizontal position.

5. The pergola shade system of claim 4, further including an adjustable plumbing system for positioning the upright support column in a substantially vertical orientation.

6. The pergola shade system of claim 5, wherein said adjustable plumbing system includes a tie-back assembly comprising at least one turnbuckle, each turnbuckle coupling the lower end of a respective one of said at least one upright support column to one of said plurality of inner floor joists of said pier.

7. The pergola shade system of claim 1, wherein the roof assembly is slidably received on said upper end of each upright support column for movement between a plurality of raised and lowered positions above said pier; and further including a hoist assembly for moving said roof assembly between said raised and lowered positions.

8. The pergola shade system of claim 7, wherein said hoist assembly comprises a winch assembly including a winch mounted adjacent the lower end of said upright support column, at least one pulley mounted on the upper end of said upright support column, and a cable extending around said pulley and attached at one end to said winch and at its other end to said roof assembly.

9. The pergola shade system of claim 1, further including an adjustable leveling system for positioning said roof assembly in a substantially horizontal orientation.

10. The pergola shade system of claim 4, further including a stabilizing assembly for the lower end of each upright support column, said stabilizing assembly comprising an integral double sleeve member having a first sleeve for receiving and securing the lower end of said upright support column, a second sleeve for receiving and securing an auxiliary leg therein in a position parallel to and adjacent to said support column, and an adjustable positioning mechanism for adjusting the vertical position of said auxiliary leg with respect to said upright support column.

11. The pergola shade system of claim 1, wherein said roof assembly includes a plurality of roof sections each movable between multiple shade-providing positions to adjust the location of the shade being cast on said pier by said roof assembly.

12. The pergola shade system of claim 11, wherein said roof assembly includes a plurality of latch members for removably mounting said roof sections at said shade-providing positions.

13. The pergola shade system of claim 3, further including an adjustable plumbing system for positioning the at least one upright support column in a substantially vertical orientation.

14. The pergola shade system of claim 13, wherein said adjustable plumbing system includes a plurality of threaded fasteners extending through said sleeve and engageable with said post for securing said post within said sleeve and adjusting the vertical orientation of said upright support column.

15. A pergola shade system comprising:

a framework having a first upright support column and a second upright support column, each upright support column having an upper end and a lower end;

a roof assembly coupled to the upper ends of the first and second upright support columns and cantilevered over a pier, the roof assembly including slider assemblies slidably received on the upper ends of the first and second upright support columns to move the roof assembly between a plurality of raised and lowered positions above the pier; and an anchor assembly including a first sleeve and a second sleeve, each sleeve having a top end removably mounted to the lower end of a respective upright support column and a bottom end removably mounted to a respective post of the pier.

16. The pergola shade system of claim 15, further including an adjustable leveling system for positioning the roof assembly in a substantially horizontal orientation.

17. The pergola shade system of claim 15, further including a hoist assembly for moving said roof assembly between said raised and lowered positions.

18. A pergola shade system comprising:

a framework having a first upright support column and a second upright support column, each upright support column having an upper end and a lower end;

a roof assembly coupled to the upper ends of the first and second upright support columns and cantilevered over a pier, the roof assembly including slider assemblies slidably received on the upper ends of the first and second upright support columns to move the roof assembly between a plurality of raised and lowered positions above the pier; and an anchor assembly including a backer plate coupled to an outer stringer joist of the pier, the backer plate coupled to and extending between the first and second upright support columns.

19. The pergola shade system of claim 18 wherein the first upright support column is coupled to the backer plate by way of a first hinge member and the second upright support column is coupled to the backer plate by way of a second hinge member, wherein the framework and roof assembly pivot about the first and second hinge members between an upright position and a prone position.

20. The pergola shade system of claim 18, further including a hoist assembly for moving said roof assembly between said raised and lowered positions.

* * * * *